United States Patent [19]

Nagamatsu et al.

[11] 4,316,435

[45] Feb. 23, 1982

[54] BOILER TUBE SILENCER

[75] Inventors: Brian H. Nagamatsu, Peabody; Barney Rolsma, Topsfield, both of Mass.

[73] Assignee: General Electric Company, Lynn, Mass.

[21] Appl. No.: 125,188

[22] Filed: Feb. 27, 1980

[51] Int. Cl.[3] ..... F22B 15/00

[52] U.S. Cl. ..... 122/235 F; 122/7 D; 165/134 R

[58] Field of Search ..... 122/235 F, 7 D, 4 R, 122/155 R, 155 A; 165/134

[56] References Cited

U.S. PATENT DOCUMENTS

| | | | |
|---|---|---|---|
| 2,893,509 | 7/1959 | Baird | 165/134 X |
| 3,263,654 | 8/1966 | Cohan et al. | 122/4 R |
| 3,265,040 | 8/1966 | Chen | 122/4 R |
| 3,651,788 | 3/1972 | Chayes | 122/4 R |
| 4,226,279 | 10/1980 | Eisinger | 122/4 R X |

OTHER PUBLICATIONS

Y. N. Chen, *Excitation Sources of the Flow Inducer Vibrations and Noise in Tube Bank Heat Exchangers*, ASME, Nov. 1977.

Zdravkovich, et al., *On the Elimination of Aerodynamic Noise in a Staggered Tube Bank*, Journal of Sound and Vibration, 1974.

Y. N. Chen, *Flow Induced Vibration and Noise in Tube--Bank Heat Exchangers Due to Von Karman Streets*, ASME, Feb. 1968.

*Primary Examiner*—Edward G. Favors

*Attorney, Agent, or Firm*—James W. Mitchell

[57] ABSTRACT

Non-contact heat exchangers comprise a gas carrying duct which has fluid carrying tubes inserted therein so that hot gas may heat the tube fluid. This simple principle is extrapolated into a heat recovery steam generator for a combined cycle power plant where hot gas turbine exhaust gases are used to heat steam turbine feed water in order to produce steam. A noise/vibration problem may be generated at certain gas turbine loads which create stimulus frequencies at or near boiler tube response frequencies. The invention proposes an optimum arrangement of upstream baffles which suppress the stimulus frequency generated by the gas flowing through the duct.

7 Claims, 5 Drawing Figures

BOILER TUBE SILENCER

BACKGROUND OF THE INVENTION

This invention relates in general, to heat exchangers; and, in particular to apparatus for decreasing noise and vibration in the heat exchanger.

One application of the present invention occurs in combination with a heat recovery steam generator (HRSG), an example of which is shown in U.S. Pat. No. 3,934,553 assigned to the assignee of the present invention. The HRSG is a free standing duct which defines a hot gas flow path in combination with a plurality of discrete tube bundles which contain a fluid to be heated and between which a non-contact heat exchange relationship occurs. The HRSG may be connected to the exhaust end of a gas turbine which provides a source of hot gas. If the tube fluid to be heated is water for eventual input into a steam turbine, the combination may be termed a combined cycle power plant. Alternatively and without limitation, the present invention may be applicable to any type of non-contact heat exchanger wherein gas is passed through tube bundles.

It has been found that at certain gas velocities through an enclosed gas duct a loud resonance will occur. In the context of a multi-tube bundle HRSG of a combined cycle power plant, as load changes are made with respect to the gas turbine, resonant noise may occur which is objectionable to the surrounding community. The acoustic resonance may also excite large amplitude lateral vibrations of the duct walls or tubes if the frequency of acoustic oscillations happens to be close to the natural frequencies of the structures.

The stimulus to the noise is the hot gas flow which changes velocity as load changes are made on the gas turbine. The response is the HRSG environment including duct width perpendicular to the gas flow and general axial orientation of the HRSG tube bundle. Other factors to be considered are the temperature gradiant within the HRSG and other physical parameters within the HRSG.

One solution of the excessive noise problem lies in dealing with the response. In other words, the response noise occurs at a particular frequency which may be altered by changing a physical parameter of the gas duct. For example, detuning baffles could be inserted between tube bank rows and hence shorten the cross section dimension of the duct. This would raise the response frequency away from the stimulus frequency. The objection to this solution is that it creates an obstruction to gas flow as well as to certain accessories such as sootblowers and often times is impossible to install at ideal locations. Hence, while viewed as one available solution the use of detuning baffles is far from an ideal solution or even a universal solution.

SUMMARY OF THE INVENTION

According to the present invention, the applicants have discovered a more universal solution to the noise problem and may be easily applied to an HRSG without interfering with duct flow characteristics or with accessories to the HRSG. That solution is based upon suppressing the stimulus frequency of the flow upstream from the tube bank.

The manner in which the stimulus frequency may be affected in order to move it away from the response frequency to avoid coincidence and resonance with the response frequency is to provide a row of baffles upstream from the main tube banks. It has been found that certain parameters contribute to the overall silencing effect of this invention. The baffles may take the form of a false row or unfinned pipes each having a diameter equal to or greater than the boiler tube diameters. The distance of the dummy pipes upstream from the main tube banks is no less than two dummy tube diameters and preferably no more than four dummy tube diameters for maximum disturbance attenuation. The centerline transverse spacing between tubes within the dummy row of tubes is the same as the centerline traverse spacing of the boiler tube bank tubes. The dummy tubes are oriented in the same direction parallel to the main tube bank.

OBJECTS OF THE INVENTION

It is an object of the invention to effect an attenuation of flow disturbance in an enclosed duct of a heat exchanger.

It is an object of the invention to provide a silencing effect in a HRSG with minimum interference with duct flow or boiler accessories.

It is a further object of the invention to provide an optimum silencing effect within a minimal duct space.

The novel features believed characteristic of the present invention are set forth in the appended claims. The invention itself however, together with further objects and advantages thereof, may best be understood with reference to the following description taken in connection with the drawings.

DETAILED DESCRIPTION OF THE INVENTION

Figure 1:
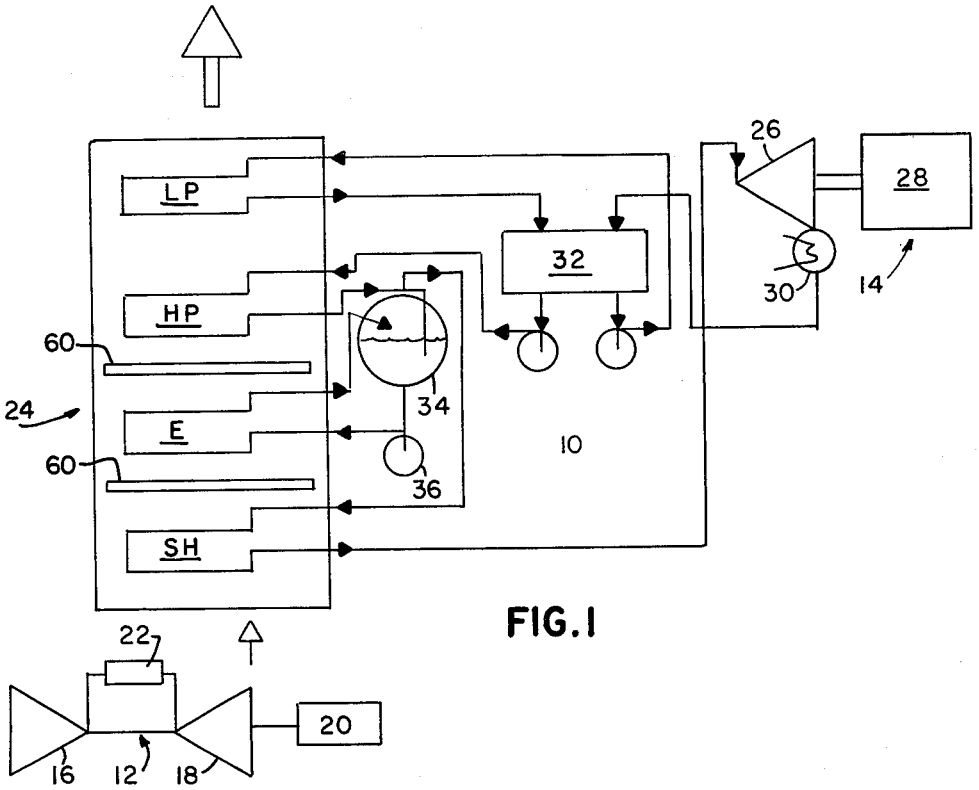
FIG. 1 is a schematic drawing of a combined cycle power plant showing the orientation of the present invention applied thereto.

FIG. 1 shows a combined cycle power plant 10 which provides one environment in which the present invention may be applied. In general, the present invention may be utilized in any duct having a stimulus and response as hereinafter described. The combined cycle power plant 10 includes a gas turbine power plant 12 and a steam turbine power plant 14. The gas turbine power plant includes a compressor 16 connected to a gas turbine 18; both, of which, are connected to a first electrical generator 20. A combustor section 22 (only one shown) ignites the fuel-air mixture which then becomes motive fluid for the turbine and further provides a hot exhaust gas into heat recovery steam generator (HRSG) 24.

The steam turbine power plant 14 includes a steam turbine 26 which drives a second electrical generator 28. Steam which has expanded through the steam turbine is condensed into water in condenser 30.

The gas turbine and the steam turbine are thermally connected through HRSG 24. The HRSG is a free standing duct or gas stack which passes gas turbine exhaust gases to the atmosphere. The HRSG may be divided into several sections or modules in accordance with well-known plumbing schemes for heating turbine feedwater into steam. According to one such scheme, from top to bottom there is a low pressure economizer LP, a high pressure economizer HP, an evaporator E and a super heater SH. The purpose of the HRSG is to provide non-contact (usually counterflow) heat exchange between gas turbine exhaust gas flowing through the duct and a steam water mixture in the aforementioned economizers, evaporator and superheater. A water conditioner system identified as 32 provides preheating of feedwater and deaeration and may include for example a flash tank and deaerator combination (not shown) in combination with the LP economizer. The HP economizer provides additional heating and transfers the steam/water mixture into a steam drum 34. Pump 36 circulates superheated water through the evaporator E so as to produce steam for superheater SH. All of the foregoing is background and does not constitute a limitation on the scope of this invention.

Figure 2:
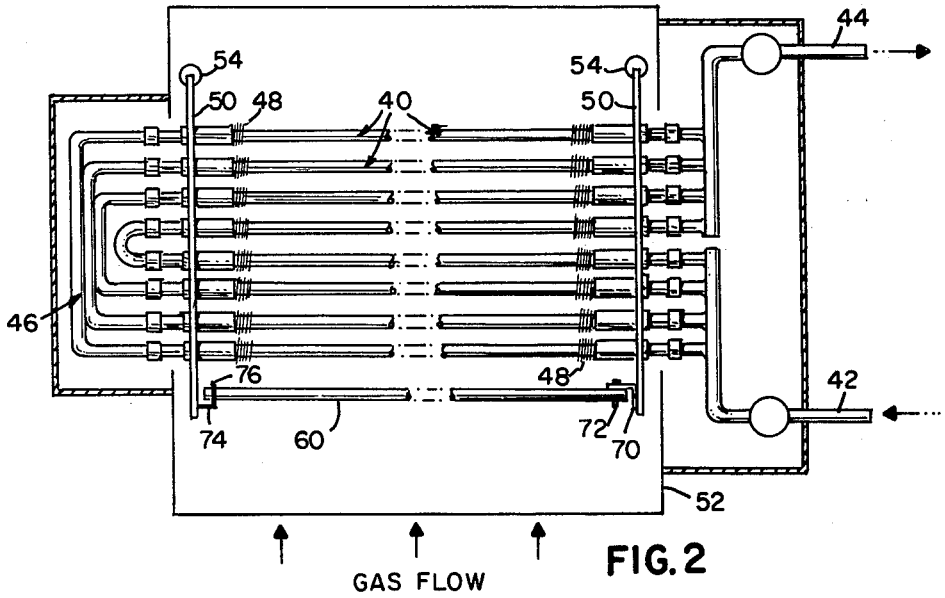
FIG. 2 is a conceptual drawing of an HRSG module showing the present invention installed upstream from the fluid carrying pipes. This is a side view of the pipes.
Figure 3:
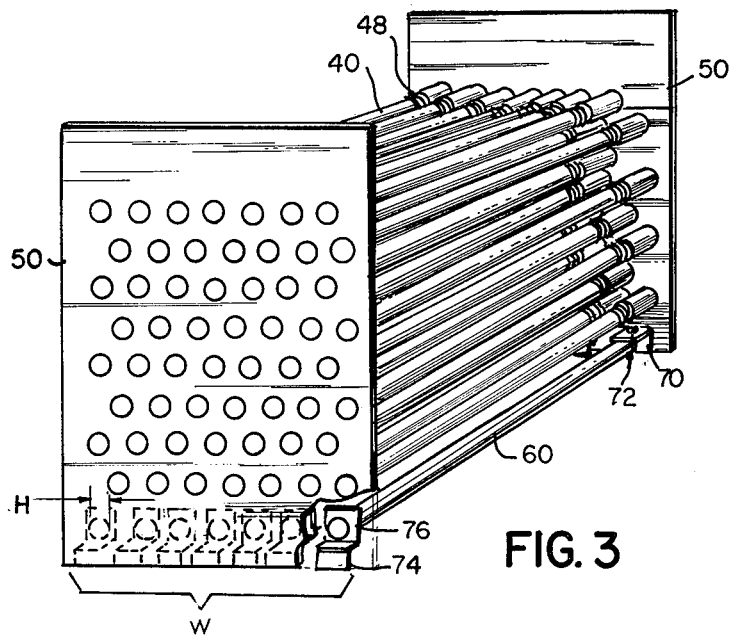
FIG. 3 is a schematic of an HRSG module showing the positioning of the present invention in the preferred embodiment.

Referring to FIGS. 2 and 3, the tube bundle of a module will be explained. For example, the evaporator E, may include a plurality of "U" shaped tubes 40 each of which are connected to an inlet header 42 at one end and an outlet header 44 at the other end. According to the usual construction of the module the "U" bends 46 are located outside of the hot gas flow path 52. Further, the tubes are formed with fins 48 (shown partially) to increase their heat transfer surface. The tube bundles are supported by steel plates 50 which are suspended within the hot gas flow path indicated generally by outline 52. The steel plates may be carried on rods 54 supported by opposite duct walls.

The duct containing the tube bundle as just described becomes the response environment and may have an audible response frequency when excited by a stimulus generated as the gas flows through the duct. In the described HRSG such a response might be audible several miles from the site of the HRSG. The noise occurs at only certain gas turbine loading conditions but is obviously objectionable to the surrounding environment. The problem occurs whenever the stimulus frequency of the exhaust gas flow approaches the fundamental response frequency or harmonic frequency of the boiler width W perpendicular to the axis of the tube bundle (FIG. 3). The proposed solution is to insert a row of baffles 60 upstream with respect to the gas flow from the main row of tubes in each module as deemed necessary. The baffles may have varying geometric shapes such as pipes, triangles or angle irons. For purposes of being consistent rather than limiting, it is preferred that the chosen geometric shape be a pipe as hereinafter described. The pipe as described would be unfinned since it has no heat exchange function as shown and described.

In describing the baffle row in terms of a pipe diameter, the referred to pipe size is given by a nominal diameter or a geometric shape of equivalent cross sectional height H. It has been determined that the nominal pipe diameter should be substantially equal to or greater than the unfinned pipe diameter of the boiler tubes. Obviously, the upper limit on baffle pipe diameter is undue obstruction of the hot gas flow area but it is pointed out that increasing the baffle pipe diameter above the minimum diameter will also increase the distance upstream from the boiler tube bank where the baffle pipe may be placed. This is practically advantageous for reasons asserted in the next paragraph.

It has been further discovered that there is an optimum minimum and maximum distance for placing the baffle pipes upstream from the main tube bank. The distance may be expressed in terms of baffle pipe diameters and falls in the range of from two diameters to four diameters. The range gives an optimum value in terms of sound attenuation. It has been discovered that at some point beyond the optimum range the attenuation results may again improve in cyclic fashion but the preferred embodiment is within the aforementioned range. Noting that a representative boiler tube diameter may be on the order of $1\frac{1}{4}$ inches if a baffle tube equal in diameter were chosen to be inserted into the HRSG then it would be from $2\frac{1}{2}$ inches to 5 inches from the first row of boiler tubes. The larger dimension is somewhat flexible but the lower dimension does not leave much working room for boiler tube sag or accessories such as sootblowers common in an HRSG. Thus if a $2\frac{1}{4}$ inch diameter pipe were used the range of placement would be from $4\frac{1}{2}$ inches to 9 inches upstream from the boiler tubes. Thus the sensitivity to spacing is decreased as the baffle tube diameter is increased.

The center to center spacing of the baffle tubes is preferably the same as the center to center spacing of the main tube bank. The baffle tubes produce optimum results when oriented in the same direction and parallel to the tubes in the main tube bank. Finally, as an additional parameter, it has been found that staggering the baffle tubes with respect to the first row of the main tube bank produces optimum results although this may be varied to accommodate mechanical or accessory requirements.

Figure 4:
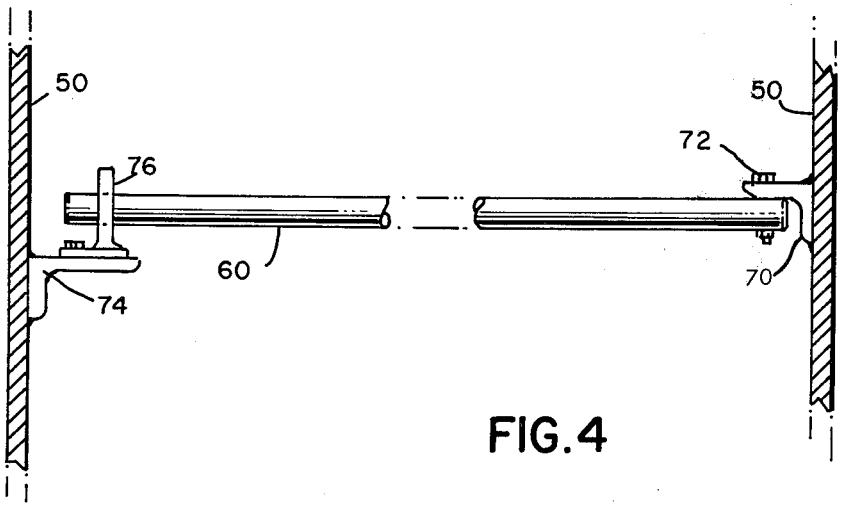
FIG. 4 is a detailed drawing showing the preferred mounting arrangement of the present invention.

Referring to FIG. 4, the baffle pipe row 60 may be mounted and supported by two end tube sheets 50. If there are intermediate tube sheets, the baffle pipe could be inserted through holes in the tube sheets as are the boiler tube bundles. An angle bracket 70 may be welded to one tube sheet whereas one end of the baffle tube may be attached to the angle bracket by means of nut and bolt 72. At the opposite end of the baffle tube, a second angle bracket 74 may be attached to the tube support sheet and a fixture 76 mounted on the bracket to allow for sliding support of the pipe. The foregoing arrangement has been found advantageous for retrofit application.

Alternatively, and as available, the baffle row could be mounted so as to extend through holes preformed in the tube support plates.

Figure 5:
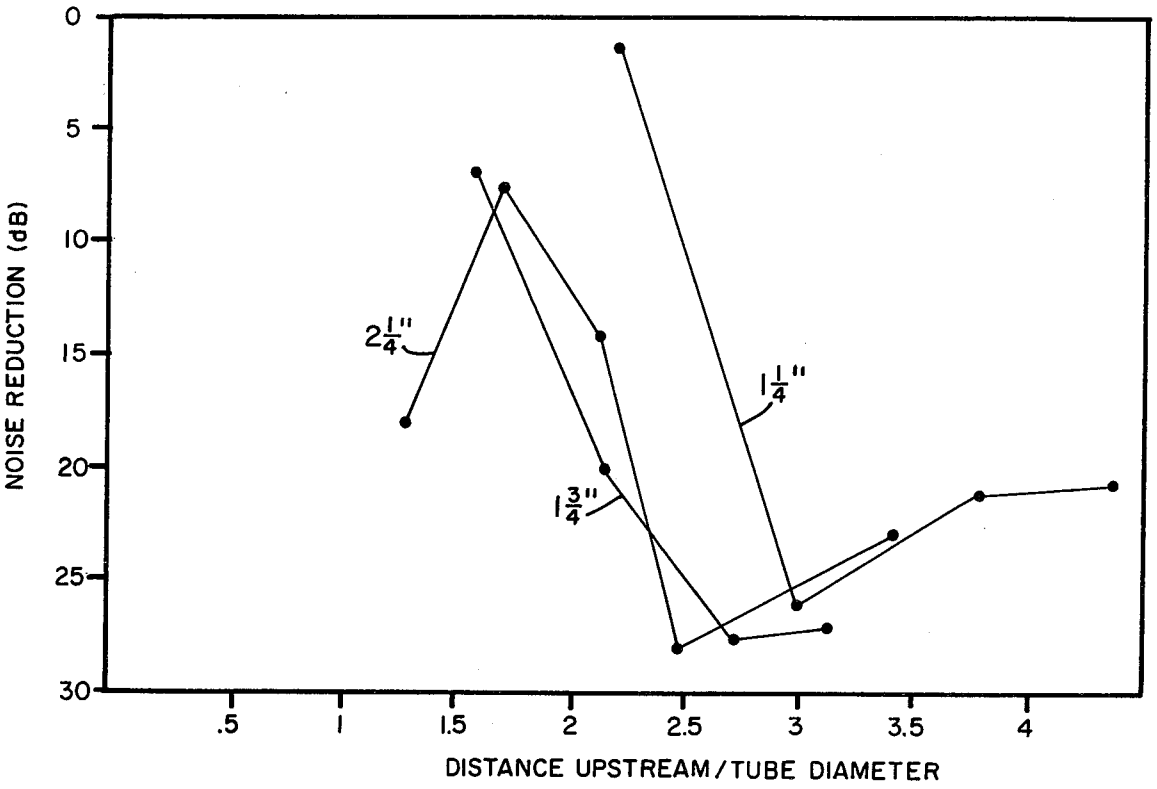
FIG. 5 is a graph indicating the improved results achieved by the present invention.

FIG. 5 shows the results of the invention. The graph ordinate gives noise reduction in terms of decibels (db) whereas the abscissa represents the baffle row distance upstream from the first row of the boiler tubes as defined in terms of baffle tube diameters. Three different size baffle tubes are used; namely, $1\frac{1}{4}$ inch, $1\frac{3}{4}$ inch and $2\frac{1}{4}$ inch. Notice that the peak reduction in noise occurs at or about 2.5 to 3 diameters upstream from the boiler tube bank. There is significant noise reduction in the range of from 2 diameters to 4 diameters. As mentioned, the noise reduction curve can be cyclic farther upstream from the boiler tubes, but practical space considerations dictate the distances as shown in FIG. 5.

While there has been shown what are considered to be the preferred embodiments of the present invention, other modifications may occur to those skilled in the art. For example, this invention has wider application than to combined cycle power plants and can be adapted to any kind of heat exchange operation. Moreover, the noise attenuating effects of this invention can also be extended to include mechanical vibration induced by flow. Although baffle tubes have been extensively described any type of geometric baffle shape might be utilized including, of course, round bars instead of hollow tubes. Finally, baffle tubes can be modified to be part of the heat exchange process and hence reference to dummy or false tubes is illustrative and not limiting. Hence baffles may include by definition fluid carrying tubes. It is intended to cover in the appended claims all such modifications as fall within the true spirit and scope of the invention.

What is claimed is:

1. A heat exchange apparatus comprising a gas carrying duct having a plurality of fluid carrying tubes disposed across the duct, said heat exchange apparatus having an upstream end and a downstream end with respect to gas flow through the duct and further including:

a single row of baffles disposed across said duct; each baffle having an equivalent cross section height substantially equal to or greater than the diameter of a fluid carrying tube; and, said single row of baffles being spaced upstream from the first row of fluid carrying tubes at a minimum distance of about twice the equivalent cross section height.

2. The heat exchange apparatus recited in claim 1 wherein the single row of baffles is spaced upstream from the first row of fluid carrying tubes at a distance of from twice to four times the equivalent cross section height.

3. The heat exchange apparatus recited in claim 1 wherein the distance between the cross section centerlines of the baffles is approximately the same as the fluid carrying tubes and said baffles are approximately parallel to the fluid carrying tubes.

4. The heat exchange apparatus recited in claim 1 wherein the baffle row is staggered with respect to the first row of fluid carrying tubes.

5. A noise reducing apparatus for a heat recovery steam generator in a combined cycle power plant wherein said heat recovery steam generator thermally connects the exhaust end of a gas turbine with the inlet end of a steam turbine through a gas carrying duct having boiler tubes mounted across said duct, said apparatus comprising:

a single row of baffle pipes mounted across said duct; each baffle pipe having a diameter at least as large as the boiler tube diameter; and, said baffle pipes being spaced upstream from the first row of said boiler pipes at a distance at least twice the baffle pipe diameter.

6. In a heat recovery steam generator including a gas carrying duct having fluid carrying tubes mounted across the duct, said duct having an upstream end and a downstream end with respect to the gas flow through the duct; a noise reducing apparatus comprising:

a single row of baffle pipes mounted across said duct; each baffle pipe having a diameter equal to or greater than a boiler tube diameter; and, said baffle pipe row being spaced upstream from the first row of said fluid carrying tubes at a distance at least twice the baffle pipe diameter; said baffle tubes having substantially the same centerline spacing as the fluid carrying tubes, and, the baffle tubes being staggered with respect to the first row of fluid carrying tubes.

7. The apparatus recited in claim 6 wherein the baffle pipes are from two to four baffle pipe diameters upstream from said fluid carrying tubes.

* * * * *